US010981396B2

(12) United States Patent
Moto

(10) Patent No.: US 10,981,396 B2
(45) Date of Patent: Apr. 20, 2021

(54) THERMAL HEAD AND THERMAL PRINTER

(71) Applicant: KYOCERA Corporation, Kyoto (JP)

(72) Inventor: Yoichi Moto, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/497,188

(22) PCT Filed: Mar. 29, 2018

(86) PCT No.: PCT/JP2018/013297
§ 371 (c)(1),
(2) Date: Sep. 24, 2019

(87) PCT Pub. No.: WO2018/181734
PCT Pub. Date: Apr. 10, 2018

(65) Prior Publication Data

US 2020/0247140 A1 Aug. 6, 2020

(30) Foreign Application Priority Data

Mar. 29, 2017 (JP) ..... JP2017-065411

(51) Int. Cl.
*B41J 2/335* (2006.01)

(52) U.S. Cl.
CPC ..... *B41J 2/3353* (2013.01); *B41J 2/3354* (2013.01); *B41J 2/3357* (2013.01); *B41J 2/33535* (2013.01); *B41J 2/33545* (2013.01)

(58) Field of Classification Search
CPC ..... B41J 2/3353; B41J 2/3354; B41J 2/3357; B41J 2/33545
See application file for complete search history.

(56) References Cited

U.S. PATENT DOCUMENTS 5,162,814 A * 11/1992 Shirakawa ..... B41J 2/33525 347/202

FOREIGN PATENT DOCUMENTS

JP 2003-220725 A 8/2003
JP 2005138484 A * 6/2005

OTHER PUBLICATIONS

JIS B 0601:2013. Geometrical Product Specifications (GPS)—Surface texture: Profile method—Terms, definitions and surface texture parameters (Foreign Standard) (2013).

* cited by examiner

*Primary Examiner* — Matthew Luu
*Assistant Examiner* — Kendrick X Liu
(74) *Attorney, Agent, or Firm* — Volpe Koenig

(57) ABSTRACT

A thermal head of the present disclosure includes a substrate 7, a heat generating unit 9, an electrode, a covering layer 27, and a covering member 29. The heat generating unit 9 is positioned above the substrate 7. The electrode is positioned above the substrate and connected to the heat generating unit 9. The covering layer 27 covers at least a part of the electrode when viewed in plan. The covering member 29 is positioned on the covering layer 27. The covering layer 27 has an upper surface 27*a* and a lateral surface 27*b* that is positioned on a side of the heat generating unit 9. An arithmetic-average surface roughness Ra of the lateral surface 27*b* is higher than an arithmetic-average surface roughness Ra of the upper surface 27*a*.

18 Claims, 9 Drawing Sheets

THERMAL HEAD AND THERMAL PRINTER

TECHNICAL FIELD

The present disclosure relates to a thermal head and a thermal printer.

BACKGROUND ART

Various thermal heads are proposed as printing devices such as facsimiles or video printers in the related art. The thermal head includes a substrate, a heat generating unit, an electrode, a covering layer, and a covering member. The heat generating unit is positioned on the substrate. The electrode is positioned on the substrate and connected to the heat generating unit. The covering layer covers at least a part of the electrode when viewed in plan. The covering member is positioned on the covering layer.

CITATION LIST

Patent Literature

PTL1: Japanese Unexamined Patent Application Publication No. 2003-220725

SUMMARY OF INVENTION

A thermal head of the present disclosure includes a substrate, a heat generating unit, an electrode, a covering layer, and a covering member. The heat generating unit is positioned above the substrate. The electrode is positioned above the substrate and connected to the heat generating unit. The covering layer covers at least a part of the electrode when viewed in plan. The covering member is positioned on the covering layer. The covering layer has an upper surface and a lateral surface that is positioned on a side of the heat generating unit. An arithmetic-average surface roughness Ra of the lateral surface is higher than an arithmetic-average surface roughness Ra of the upper surface.

A thermal printer of the present disclosure includes the thermal head, a transport mechanism transporting a recording medium such that the medium passes over the heat generating unit, and a platen roller pressing the recording medium.

DESCRIPTION OF EMBODIMENTS

A thermal head in the related art is provided with a covering layer covering a part of an electrode and having an upper surface and a lateral surface. The covering layer is provided with a covering member. In applying a resin for covering member on the covering layer, the resin for covering member on the upper surface of the covering layer can be spread almost uniformly when an arithmetic-average surface roughness Ra of the upper surface of the covering layer is low. Then, curing of the resin for covering member stabilizes the shape (spread state or height) of the covering member so that a contact state between the covering member and the recording medium can be made uniform.

However, when the surface roughness of the lateral surface of the covering layer is as low as the arithmetic-average surface roughness Ra of the upper surface, the contact area between the lateral surface of the covering layer and the recording medium increases and the recording medium is not readily being peeled off from the lateral surface of the covering layer.

The thermal head of the present disclosure enables the covering member and the recording medium to contact with each other in a uniform state and the recording medium to easily peel off from the lateral surface of the covering layer and to be transported smoothly. In the following, the thermal head of the present disclosure and a thermal printer using the same will be described in detail.

First Embodiment

Figure 1:
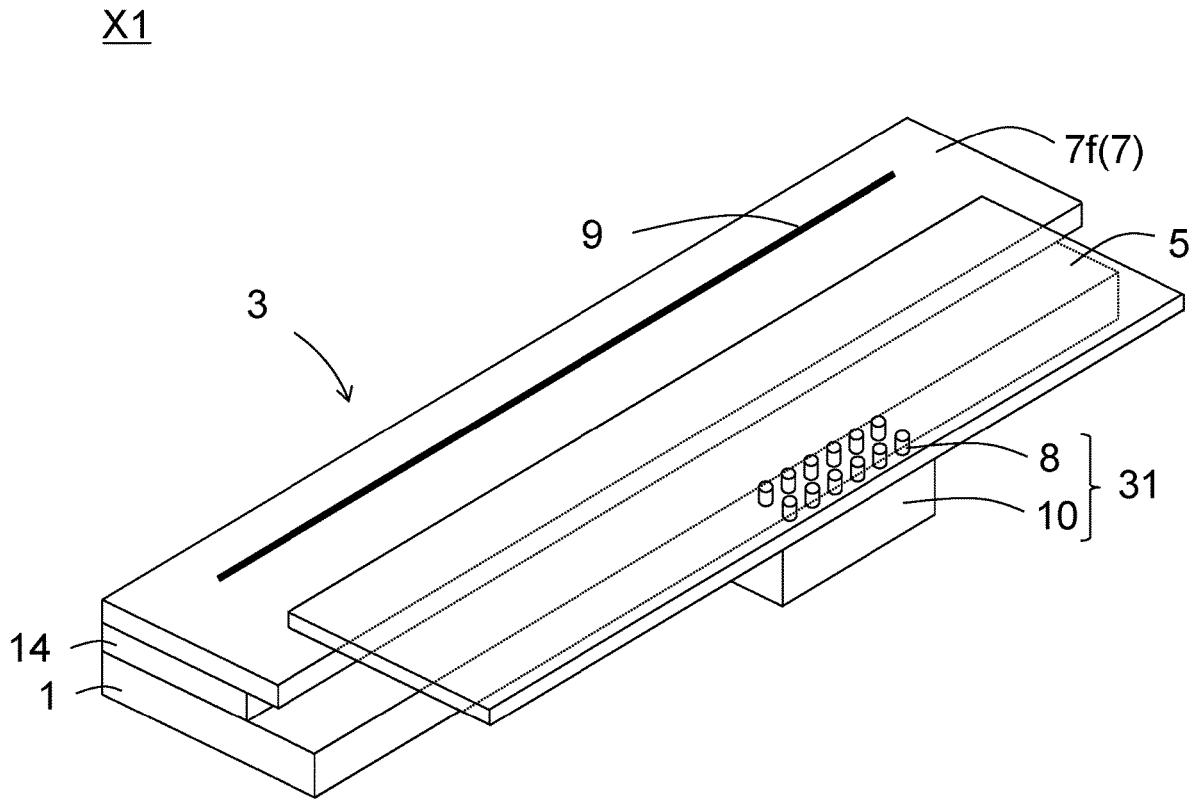
FIG. 1 is an exploded perspective view showing an outline of a thermal head according to a first embodiment.
Figure 2:
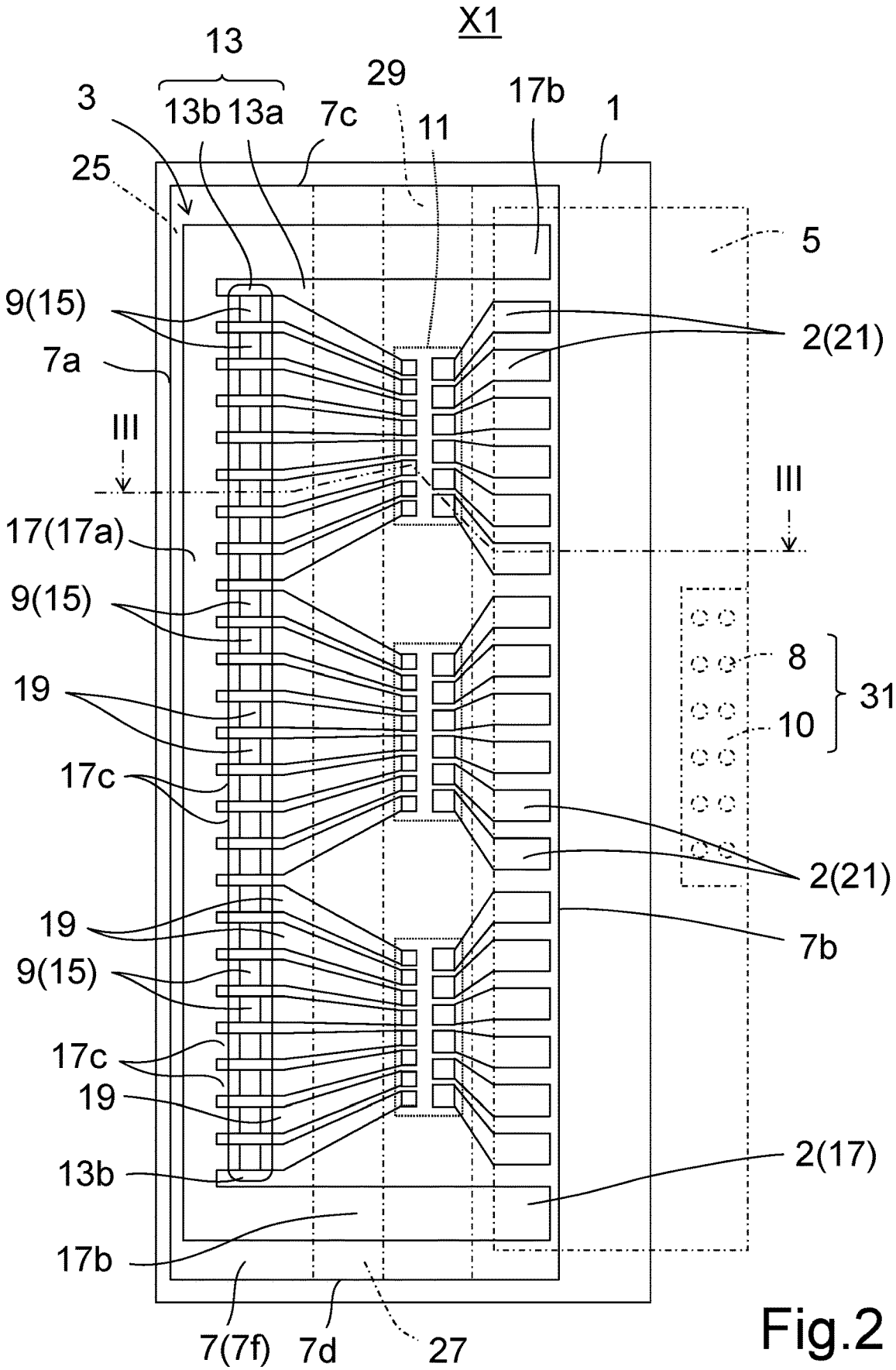
FIG. 2 is a plan view of the thermal head shown in FIG. 1.
Figure 4:
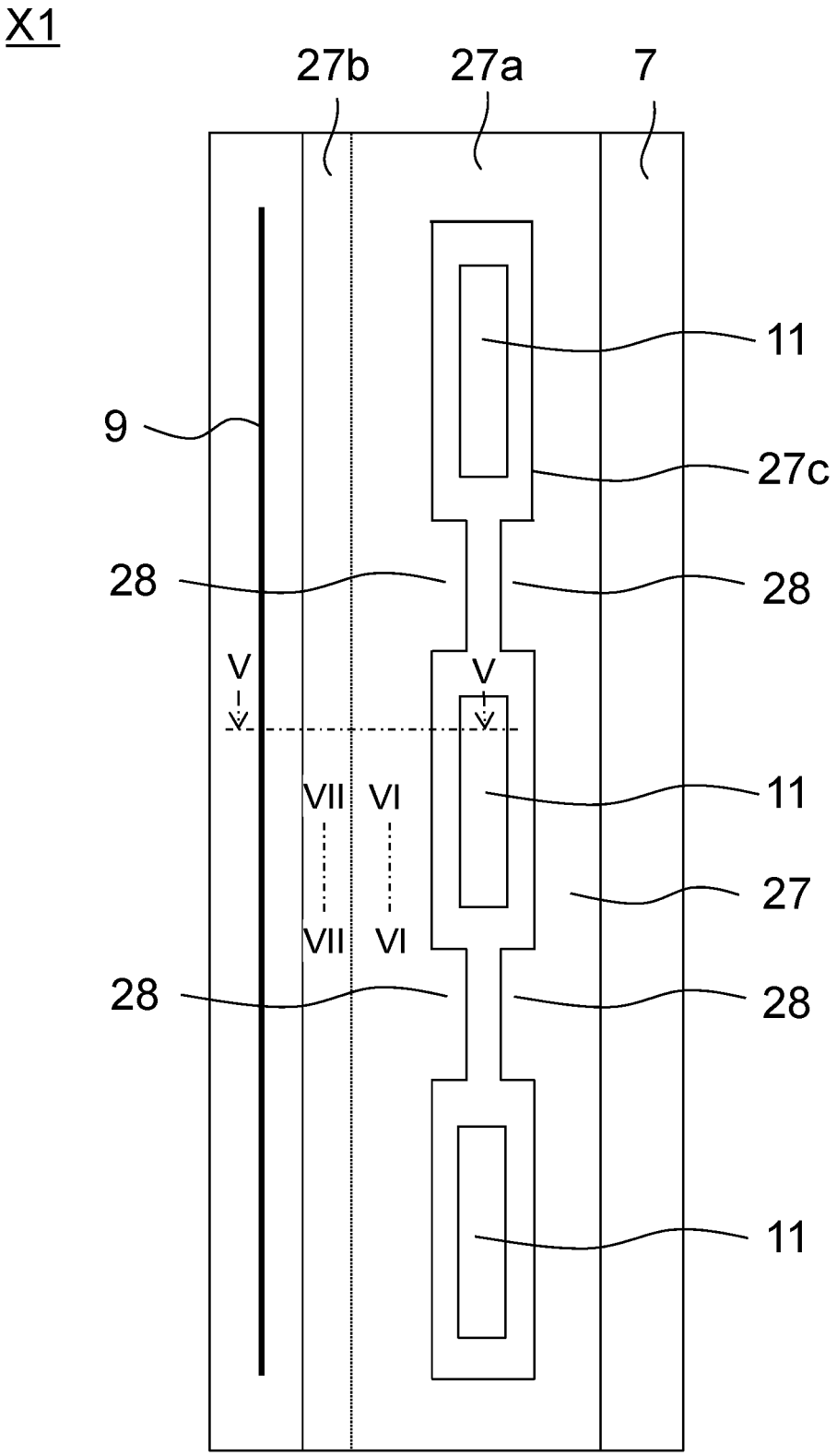
FIG. 4 is a plan view showing an outline of the thermal head shown in FIG. 1.
Figure 5:
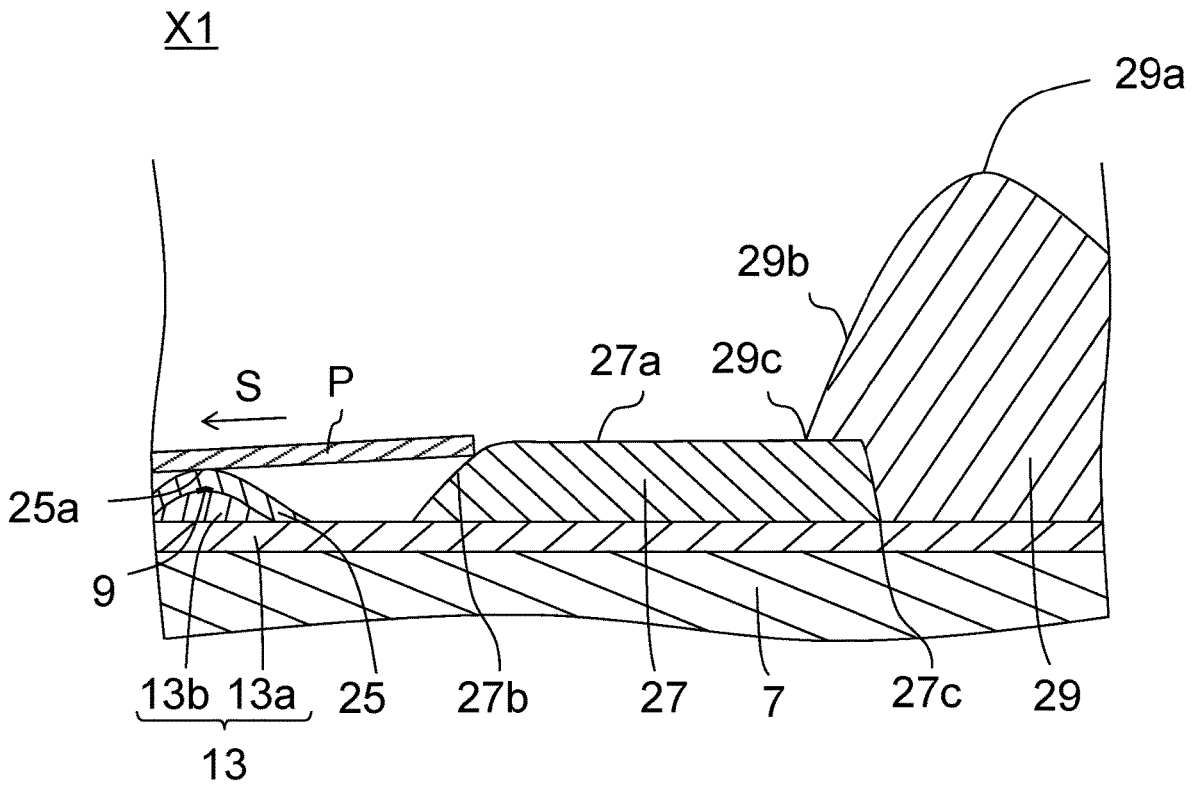
FIG. 5 is a cross-sectional view taken along line V-V shown in FIG. 4.

In the following, a thermal head X1 will be described with reference FIGS. 1 to 7. In FIG. 2, a protective layer 25, a covering member 29, a covering layer 27, a flexible printed circuit 5 (referred to as FPC hereinafter), and a connector 31 are omitted and denoted by single-dot dashed lines. In FIG. 4, an illustration of the covering member 29 is omitted for better understanding. In FIG. 5, an illustration of a driver IC 11 is omitted.

The thermal head X1 includes a heat sink 1, a head base 3, the FPC 5, an adhesion member 14, and the connector 31. The heat sink 1, the FPC 5, the adhesion member 14, and the connector 31 need not necessarily be included.

The heat sink 1 is disposed to dissipate the heat of the head base 3. The head base 3 performs printing on a recording medium P (refer to FIG. 5) by the application of a voltage from the outside. The adhesion member 14 glues the head base 3 and the heat sink 1 together. The FPC 5 is electrically connected to the head base 3. The connector 31 is electrically connected to the FPC 5.

The heat sink 1 has a rectangular parallelepiped shape. The heat sink 1 is formed of a metal material such as copper, iron, or aluminum, for example, and dissipates, of the heat generated in the head base 3, the heat not contributing to printing.

The head base 3 is formed long in the main scanning direction and has a rectangular shape when viewed in plan. The head base 3 is provided with respective members constituting the thermal head X1 on a substrate 7. The head base 3 performs printing on the recording medium P in accordance with an electric signal supplied from the outside.

The adhesion member 14 is positioned on the heat sink 1 and joins the head base 3 to the heat sink 1. As the adhesion member 14, a double-sided tape or a resinous adhesive can be used, for example. Both the double-sided tape and the resinous adhesive may be used to join the head base 3 to the heat sink 1.

The FPC 5 is electrically connected to the head base 3 and is disposed adjacent to the head base 3 in the sub-scanning direction. The connector 31 is electrically connected to the FPC 5. Accordingly, the head base 3 is electrically connected to the outside through the FPC 5.

The connector 31 has a plurality of connector pins 8 and a housing 10. The connector 31 is positioned below the FPC 5. The connector pin 8 is electrically connected to an end portion of the FPC 5. The housing 10 accommodates a plurality of connector pins 8.

Respective members constituting the head base 3 and the FPC 5 will be described with reference to FIGS. 1 to 3.

The head base 3 has the substrate 7, a heat storage layer 13, an electric resistance layer 15, a common electrode 17, an individual electrode 19, a connection electrode 21, a terminal 2, a conduction member 23, the driver integrated circuit (IC) 11, the covering member 29, the protective layer 25, and the covering layer 27. These members may not necessarily be all provided. Further, the head base 3 may include members other than these.

The substrate 7 is positioned on the heat sink 1 and has a rectangular shape when viewed in plan. The substrate 7 has a first surface 7*f* and a second surface 7*g*. The first surface 7*f* has a first long side 7*a*, a second long side 7*b*, a first short side 7*c*, and a second short side 7*d*. The second surface 7*g* is positioned on the opposite side of the substrate 7 from the first surface 7*f*. The first surface 7*f* is provided with respective members constituting the head base 3. The second surface 7*g* is disposed on a side of the heat sink 1 and is joined to the heat sink 1 with the adhesion member 14 interposed therebetween. The substrate 7 is formed of an electrically insulating material such as alumina ceramics or the like or a semiconductor material such as single-crystal silicon or the like.

The surface 7*f* of the substrate 7 is provided with the heat storage layer 13. The heat storage layer 13 has a base portion 13*a* and a raised portion 13*b*. The base portion 13*a* is disposed over the whole surface of the first surface 7*f* of the substrate 7. The raised portion 13*b* is raised from the base portion 13*a* upward above the substrate 7. In other words, the raised portion 13*b* protrudes away from the first surface 7*f* of the substrate 7.

The raised portion 13*b* is positioned adjacent to the first long side 7*a* of the substrate 7 and extends in the main scanning direction. The cross section of the raised portion 13*b* is approximately semi-elliptical. Accordingly, the protective layer 25 on the heat generating unit 9 to be described below comes into good contact with the recording medium P to be printed. The height of the base portion 13*a* from the substrate 7 can be set to 50 to 160 μm and the height of the raised portion 13*b* from the base portion 13*a* can be set to 30 to 60 μm.

The heat storage layer 13 is formed of glass having low thermal conductivity and temporarily stores a part of the heat generated by the heat generating unit 9. Therefore, the time required for raising the temperature of the heat generating unit 9 can be cut short and the thermal response characteristic of the thermal head X1 can be enhanced.

The heat storage layer 13 is formed by application of a predetermined glass paste to the first surface 7*f* of the substrate 7 by well-known screen printing or the like and firing of the same, the glass paste being obtained from a mixture of an appropriate organic solvent with glass powder, for example. The raised portion 13*b* can be formed by etching. Alternatively, it is possible to form the raised portion 13*b* by applying the portion to become the raised portion 13*b* after the base portion 13*a* is formed.

The upper surface of the heat storage layer 13 is provided with the electric resistance layer 15 and the common electrode 17, the individual electrode 19, and the connection electrode 21 are formed on the electric resistance layer 15. An exposed region in which the electric resistance layer 15 is exposed is formed between the common electrode 17 and the individual electrode 19.

As shown in FIG. 2, the exposed regions of the electric resistance layer 15 are positioned in a row on the raised portion 13*b* of the heat storage layer 13 and each exposed region constitutes the heat generating unit 9 respectively. The electric resistance layer 15 need not necessarily be disposed between the various electrodes and the heat storage layer 13. For example, the electric resistance layer 15 may only be disposed between the common electrode 17 and the individual electrode 19.

A plurality of heat generating units 9 is illustrated in a simplified manner in FIG. 2 for the sake of description, but the heat generating units 9 are positioned at a density of, for example, 100 to 2,400 dots per inch (dpi). The electric resistance layer 15 is formed of a material having a relatively high electric resistance such as TaN-based material, TaSiO-based material, TaSiNO-based material, TiSiO-based material, TiSiCO-based material, or NbSiO-based material. Therefore, the heat generating unit 9 generates heat by Joule heating when a voltage is applied to the heat generating unit 9.

The common electrode 17 includes a main wiring portion 17*a*, a sub-wiring portion 17*b*, and a lead portion 17*c*. The common electrode 17 electrically connects the plurality of heat generating units 9 to the connector 31. The main wiring portion 17*a* extends along the first long side 7*a* of the substrate 7. The sub-wiring portion 17*b* extends along the first short side 7*c* and the second short side 7*d* of the substrate 7. The lead portion 17*c* individually extends from the main wiring portion 17*a* toward each heat generating unit 9.

A plurality of individual electrodes 19 electrically connects the heat generating unit 9 to the driver IC 11. The plurality of heat generating units 9 is divided into a plurality of groups and the driver IC 11 disposed in correspondence to each group of the heat generating units 9 is electrically connected by the individual electrodes 19.

A plurality of connection electrodes 21 electrically connects the driver IC 11 to the connector 31. The plurality of connection electrodes 21 connected to the respective driver ICs 11 is composed of a plurality of wiring lines having different functions.

The common electrode 17, the individual electrode 19, and the connection electrode 21 are formed of a conductive material, for example, any kind of metal among aluminum, gold, silver, and copper or an alloy thereof.

The second long side 7*b* of the first surface 7*f* is provided with the terminal 2 to connect the common electrode 17 and the connection electrode 21 to the FPC 5. The terminal 2 is disposed in correspondence to an external terminal of the FPC 5 to be described below.

Figure 3:
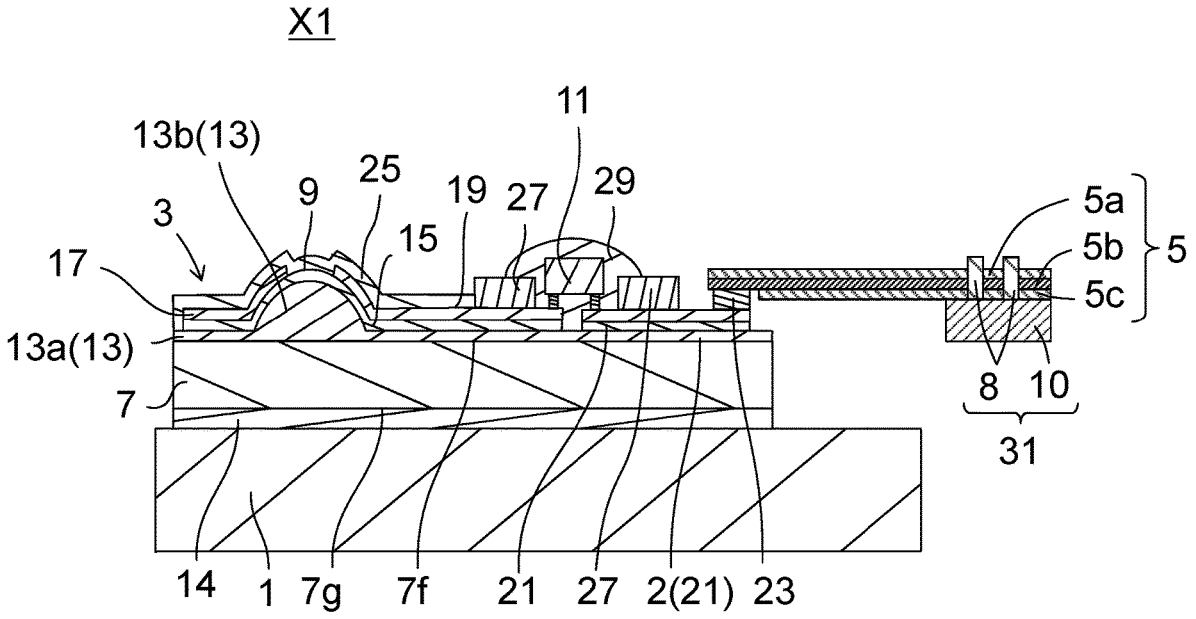
FIG. 3 is a cross-sectional view taken along line III-III shown in FIG. 2.

As shown in FIG. 3, the terminal 2 is provided with a conduction member 23. An example of the conduction member 23 may include solder, anisotropic conductive paste (ACP), and the like. A plated layer (not shown) of Ni, Au, or Pd may be disposed between the conduction member 23 and the terminal 2.

Various electrodes constituting the head base 3 can be formed by sequential lamination of metal material layers of Al, Au, Ag, Ni, or the like constituting the respective electrodes on the heat storage layer 13 by a thin film formation technique such as the sputtering method and subsequent processing of the laminate into a predetermined pattern by well-known photo etching or the like. The various electrodes constituting the head base 3 can be simultaneously formed by the same process.

The driver IC 11 is connected to the individual electrode 19 and the connection electrode 21. The driver IC 11 has a function of controlling a conduction state of each heat generating unit 9. As the driver IC 11, a switching IC having a plurality of switching elements can be used.

The protective layer 25 covers the heat generating unit 9, the common electrode 17 and a part of the individual electrode 19 and protects the covered regions from corrosion caused by adhesion of moisture contained in the atmosphere or abrasion caused by contact with the recording medium P to be printed.

The protective layer 25 can be formed of TiN, TiCN, SiC, $SiO_2$, SiON, SiN, TaN, or TaSiO, for example. The thickness of the protective layer 25 can be 2 to 15 μm, for example. The protective layer 25 can be formed by a sputtering method, a screen printing method, or an ion plating method, for example.

The substrate 7 is provided with the covering layer 27 covering the common electrode 17, a part of the individual electrode 19, and a part of the connection electrode 21. The covering layer 27 protects the covered region from oxidation caused by contact with the atmosphere or corrosion caused by adhesion of moisture and the like contained in the atmosphere. The covering layer 27 can be formed of a resin material such as an epoxy resin, a polyimide resin, a silicone resin, or the like.

The driver IC 11 is sealed with the covering member 29 made of a resin such as an epoxy resin, a silicone resin or the like in a state of being connected to the individual electrode 19 and the connection electrode 21. The covering member 29 is disposed to extend in the main scanning direction and integrally seals the plurality of driver ICs 11.

As shown in FIG. 3, the FPC 5 has a base substrate 5*a*, a wiring conductor 5*b*, and a cover substrate 5*c*. The base substrate 5*a* has a rectangular shape when viewed in plan and has the same shape as the outer shape of the FPC 5. The wiring conductor 5*b* is disposed on the base substrate 5*a* and is patterned by etching. The wiring conductor 5*b* has an external terminal at an end portion, and the external terminal is electrically connected to the terminal 2 of the head base 3. The base substrate 5*a* is provided with the cover substrate 5*c* to cover the wiring conductor 5*b*, and the external terminal is exposed from the cover substrate 5*c*.

The connector pin 8 of the connector 31 is disposed to penetrate the FPC 5. Accordingly, the connector pin 8 and the wiring conductor 5*b* are electrically connected to each other. The connector pin 8 may be electrically connected to the FPC 5 through solder or the like.

Figure 6:
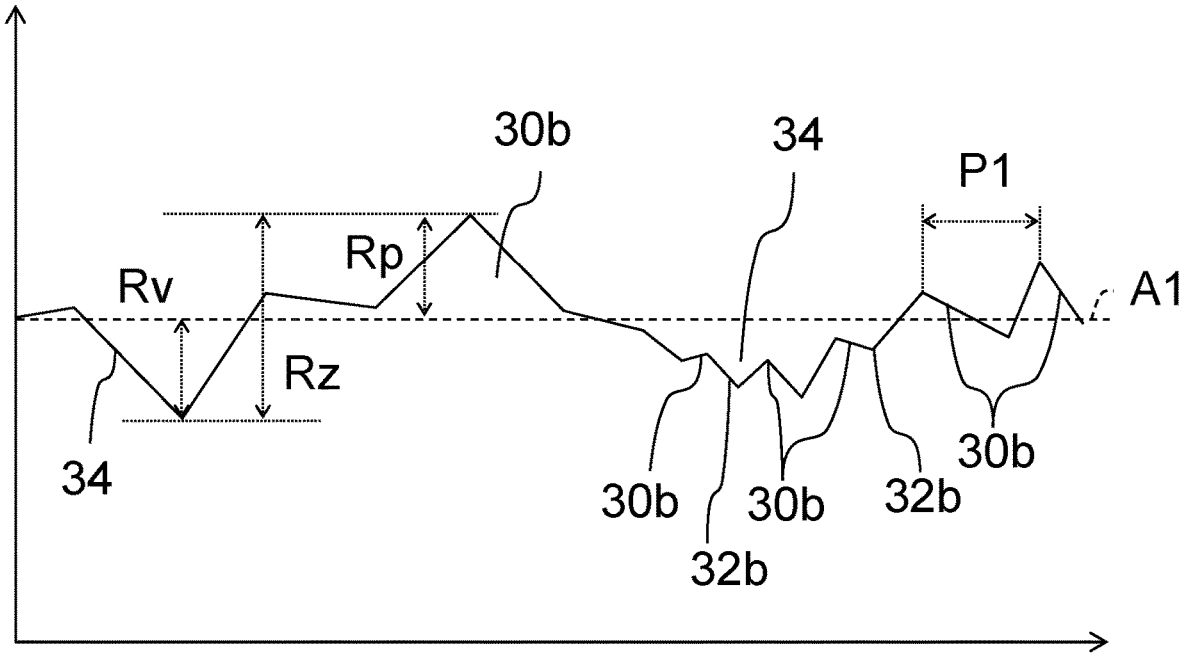
FIG. 6 is a view showing roughness curve of an upper surface of a covering layer taken along line VI-VI shown in FIG. 4.
Figure 7:
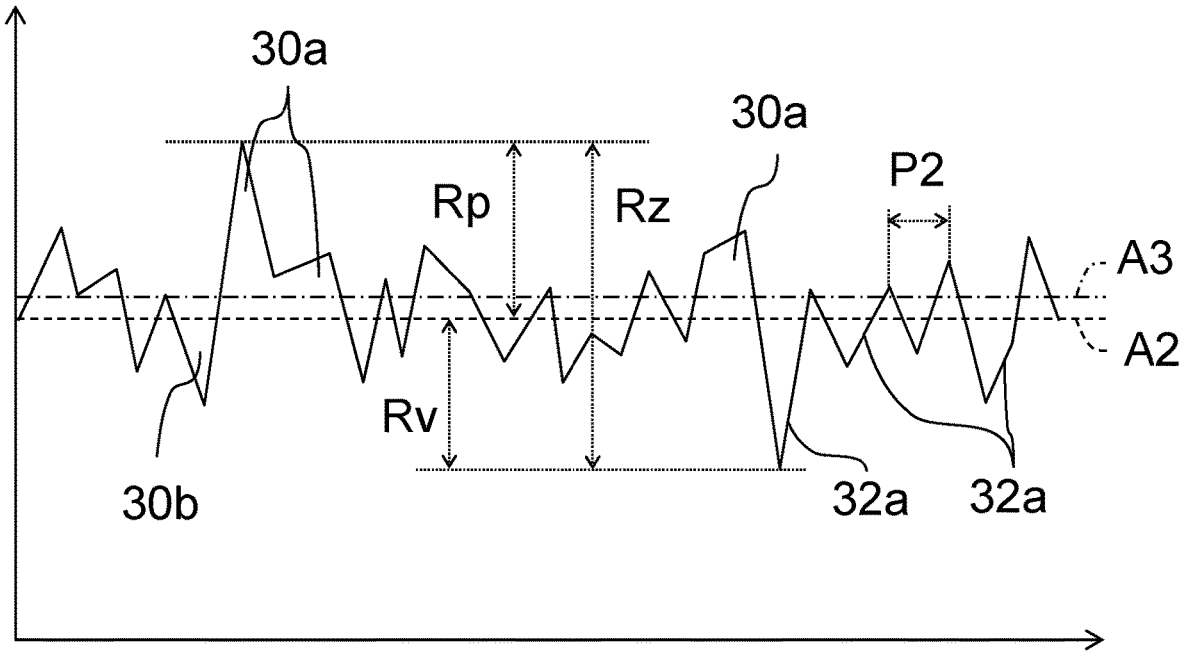
FIG. 7 is a view showing roughness curve of a lateral surface the covering layer taken along line VII-VII shown in FIG. 4.

Next, the protective layer 25, the covering layer 27, and the covering member 29 of the thermal head X1 will be described with reference to FIGS. 4 to 7 in detail. FIG. 5 shows a transport state of the recording medium P and shows the transport direction of the recording medium P by S. FIG. 6 shows a roughness curve of an upper surface 27*a* by a solid line and a mean line A1 of the roughness curves by a broken line. FIG. 7 shows a roughness curve of a lateral surface 27*b* by a solid line, shows a mean line A2 of the roughness curve by a broken line, and shows a mean line A3 of the vertices of first protrusion portions 30*a* by a single-dot dashed line.

The protective layer 25 is disposed to cover the heat generating unit 9 and is disposed to cover the heat generating unit 9 and the raised portion 13*b*. Therefore, a cross-sectional shape of the surface of the protective layer 25 is an arc shape protruding upward. A vertex 25*a* of the protective layer 25 is positioned on the heat generating unit 9 and is disposed to contact with the recording medium P. That is, the recording medium P is transported while being in contact with the vertex 25*a*.

The covering member 29 has a vertex 29*a*, a lateral surface 29*b*, and an edge 29*c*. The cross-sectional shape of the covering member 29 is a semi-elliptical shape protruding upward. Of the covering member 29, the edge 29*c* is positioned closest to the raised portion 13*b*. The covering member 29 is disposed to seal an opening 27*c* of the covering layer 27 and the edge 29*c* is positioned on the upper surface 27*a* of the covering layer 27.

The lateral surface 29*b* is positioned on a side of the raised portion 13*b* and is disposed between the vertex 29*a* and the edge 29*c*. The vertex 29*a* and the lateral surface 29*b* are disposed to contact with the recording medium P. That is, the recording medium P is transported while being in contact with the vertex 29*a* and the lateral surface 29*b*.

The covering layer 27 is positioned between the protective layer 25 and the covering member 29 and has the upper surface 27*a* and the lateral surface 27*b*. The upper surface 27*a* is provided with the opening 27*c*. The opening 27*c* is provided such that a part of the individual electrode 19 (refer to FIG. 2) and a part of the connection electrode 21 (refer to FIG. 2) is exposed so that the driver IC 11 is mounted.

As shown in FIG. 4, the opening 27*c* is formed long in the main scanning direction. The opening 27*c* is provided with an extension portion 28 extending in the sub-scanning direction in a region where the driver IC 11 is not mounted. In other words, the opening 27*c* has the extension portion 28 extending between the driver ICs 11 when viewed in plan.

As shown in FIG. 5, the lateral surface 27*b* is inclined with respect to the thickness direction of the substrate 7. The thickness of the covering layer 27 from the base portion 13*a* gradually decreases toward the end portion positioned on the side of the raised portion 13*b*. The upper surface 27*a* and the lateral surface 27*b* are disposed in contact with the recording medium P. That is, the recording medium P is transported while being in contact with the upper surface 27*a* and the lateral surface 27*b*.

As shown in FIG. 6, the upper surface 27*a* is provided with a plurality of second protrusion portions 30*b* separated from each other. A second recess portion 32*b* is disposed between the plurality of second protrusion portions 30*b* adjacent to each other. The second protrusion portion 30*b* and the second recess portion 32*b* are alternately disposed in the main scanning direction.

The arithmetic mean roughness Ra of the upper surface 27*a* is set to 0.04 to 0.09 μm, for example. The arithmetic mean roughness Ra is a value defined in JIS B 0601 (2013).

The maximum height Rz of the upper surface 27*a* is set to 0.20 to 5.0 μm. The maximum height Rz is the sum of a maximum peak height Rp of the roughness curve and a maximum valley depth Rv of the roughness curve. The maximum height Rz is a value defined in JIS B 0601 (2013).

As shown in FIG. 6, an interval P1 between the second protrusion portions 30*b* adjacent to each other is set to 2.5 to 5.0 μm, for example.

A mean length RSm of the upper surface 27*a* is set to 14.0 to 22.0 μm, for example. The mean length RSm is the mean of lengths of contour curve elements in the reference length. The mean length RSm is a value defined in JIS B 0601 (2013).

A skewness Rsk of the upper surface 27*a* is set higher than zero, to 0.1 to 1.0 μm for example. The skewness Rsk is an indicator representing the ratio of the hill to the valley with the mean height in the roughness curve as a center line. If the skewness Rsk is higher than zero, it indicates that there are more hills than valleys. The skewness Rsk is a value defined in JIS B 0601 (2013).

A kurtosis Rku of the upper surface 27*a* is set lower than 3, to 1.0 to 2.8 for example. The kurtosis Rku is an indicator representing peakedness which is a measure of the sharpness of a surface state. The kurtosis Rku is a value defined in JIS B 0601 (2013).

The upper surface 27*a* is provided with a depression portion 34. The depression portion 34 is depressed compared with a region (region around the depression portion 34) of the upper surface 27*a* where the depression portion 34 is not disposed. The depression portion 34 is depressed more than the mean line A1 of the roughness curve of the upper surface 27*a*. The depression portion 34 has the second protrusion portion 30*b* inside.

As shown in FIG. 7, the lateral surface 27*b* is provided with a plurality of first protrusion portions 30*a* separated from each other. A first recess portion 32*a* is disposed between the plurality of first protrusion portions 30*a* adjacent to each other. The first protrusion portion 30*a* and the first recess portion 32*a* are alternately disposed in the main scanning direction.

The arithmetic mean roughness Ra of the lateral surface 27*b* is set to 0.1 to 7.0 μm, for example.

The maximum height Rz of the lateral surface 27*b* is set to 0.9 to 110.0 μm, for example.

An interval P2 between the first protrusion portions 30*a* adjacent to each other shown in FIG. 7 is set to 5.9 to 10.9 μm, for example.

The mean length RSm of the lateral surface 27*b* is set to 9.0 to 20.0 μm, for example. The skewness Rsk of the lateral surface 27*b* is set higher than zero, to 3.0 to 6.0 for example. The kurtosis Rku of the lateral surface 27*b* is set higher than 3, to 10.0 to 30.0 for example.

In the cross section in the thickness direction of the substrate 7 and the main scanning direction, the mean line A3 of the vertex distribution of the first protrusion portion 30*a* is positioned above the mean line A2 of the roughness curve of the lateral surface 27*b*.

The arithmetic mean roughness Ra, the maximum height Rz, the mean length RSm, the skewness Rsk, and the kurtosis Rku can be measured in accordance with JIS B 0601 (2013), for example. A contact type surface roughness meter or a non-contact type surface roughness meter can be used for the measurement, and, for example, LEXT OLS4000 made by Olympus can be used. The measurement length of 0.4 mm, the cutoff value of 0.08 mm, the spot diameter of 0.4 μm, and the scanning speed of 1 mm/second may be used as measurement conditions, for example.

The interval P1 between the second protrusion portions 30*b* and the interval P2 between the first protrusion portions 30*a* can be obtained by measuring roughness curve of the upper surface 27*a* or the lateral surface 27*b* with a contact type or non-contact type surface roughness meter, counting the number of the first protrusion portions 30*a* or the second protrusion portions 30*b* over a predetermined length (50 μm, for example), and dividing the total number of the first protrusion portions 30*a* or the second protrusion portions 30*b* by the predetermined length. It is also possible to cut the thermal head X1 in the thickness direction of the substrate 7 and the main scanning direction to obtain a cross section and calculate from the cut surface.

The thermal head X1 has a configuration in which the arithmetic-average surface roughness Ra of the lateral surface 27*b* is higher than the arithmetic-average surface roughness Ra of the upper surface 27*a*. In other words, the thermal head X1 has a configuration in which the arithmetic-average surface roughness Ra of the upper surface 27*a* is lower than the arithmetic-average surface roughness Ra of the lateral surface 27*b*. Accordingly, when the resin for the covering member 29 is applied to the upper surface 27*a* of the covering layer 27, the resin for the covering member 29 on the upper surface 27*a* can be spread almost uniformly.

Therefore, the way the resin for the covering member 29 is spread does not differ depending on the position and the shape of the resin for the covering member 29 can be further stabilized. As a result, as for the covering member 29 into which the resin for the covering member 29 is cured, the covering member 29 and the recording medium P are in almost uniform contact with each other and the recording medium P can be transported smoothly.

Since the arithmetic-average surface roughness Ra of the lateral surface 27*b* is higher than the arithmetic-average surface roughness Ra of the upper surface 27*a*, the contact area between the recording medium P and the lateral surface 27*b* is reduced, the recording medium P easily peels off from the lateral surface 27*b*, and thus, the recording medium P can be transported smoothly.

In the thermal head X1 of the present embodiment, the maximum height Rz of the lateral surface 27*b* may be greater than the maximum height Rz of the upper surface 27*a*. In such a configuration, even when a paper fragment or dust (referred to paper fragment hereinafter) is transported on the lateral surface 27*b* along with the transport of the recording medium P, the paper fragment or the like can be accommodated in the first recess portion 32*b* and the paper fragment or the like is hardly transported onto the heat generating unit 9. Accordingly, the thermal head X1 is hardly damaged.

In the thermal head X1 of the present embodiment, the upper surface 27*a* may be provided with the depression portion 34. In such a configuration, a gap is generated between the recording medium P and the upper surface 27*a* and the contact area between the recording medium P and the upper surface 27*a* can be reduced. As a result, the recording medium P hardly gets stuck to the upper surface 27*a* and the recording medium P can be transported smoothly.

Further, since the upper surface 27*a* is provided with the depression portion 34, even when a paper fragment or the like breaking loose from the recording medium P is transported onto the upper surface 27*a* together with the recording medium P, the depression portion 34 can accommodate the paper fragment or the like and the paper fragment or the like is hardly transported onto the heat generating unit 9.

The depression portion 34 may be positioned away from the covering member 29. In such a configuration, the resin for the covering member 29 hardly enters the depression portion 34 and the stability of the shape of the covering member 29 can be ensured.

Further, in the thermal head X1 of the present embodiment, the second protrusion portion 30*b* may be disposed inside the depression portion 34. In such a configuration, even when the recording medium P is deformed by static electricity and enters the inside of the depression portion 34, a gap can be generated between the recording medium P and the depression portion 34 and the contact area between the recording medium P and the upper surface 27*a* can be reduced. Accordingly, the recording medium P can be transported smoothly.

Further, when a paper fragment or the like is accommodated in the depression portion 34, the paper fragment or the like is captured by the second protrusion portion 30*b* and the possibility of the paper fragment or the like being discharged from the depression portion 34 can be reduced.

In the thermal head X1 of the present embodiment, the interval P2 between the first protrusion portions 30*a* adjacent to each other may be smaller than the interval P1 between the second protrusion portions 30*b* adjacent to each other. In such a configuration, the recording medium P can be supported by the first protrusion portion 30*a* while a gap between the recording medium P and the lateral surface 27*b* is ensured.

That is, the lateral surface 27*b* is disposed in the vicinity of a platen roller 50 (refer to FIG. 8) and the pressing force by the platen roller 50 is applied to the lateral surface 27*b* via the recording medium P, but the recording medium P can be supported by a plurality of first protrusion portions 30*a*.

In the thermal head X1 of the present embodiment, the mean line A3 of the vertex distribution of the first protrusion portion 30*a* may be positioned above the mean line A2 of roughness curves of the lateral surface 27*b* in the cross section in the thickness direction of the substrate 7 and the main scanning direction. In such a configuration, the lateral surface 27*b* can stably support the recording medium P by the first protrusion portion 30*a* and the medium P can be smoothly transported toward the vertex 25*a* of the protective layer 25.

The lateral surface 27*b* may be inclined with respect to the thickness direction of the substrate 7 and the height from the base portion 13*a* may be lowered toward the raised portion 13*b*. In such a configuration, the recording medium P does not come into surface contact but into line contact with the lateral surface 27*b* in the sub-scanning direction. As a result, the contact area between the recording medium P and the lateral surface 27*b* can be reduced.

In the thermal head X1 of the present embodiment, the mean length RSm of the upper surface 27*a* may be shorter than the mean length RSm of the lateral surface 27*b*. In such a configuration, the interval P1 between the second protrusion portions 30*b* of the upper surface 27*a* can be made smaller than the interval P2 between the first protrusion portions 30*a* of the lateral surface 27*b*. As a result, the contact area between the upper surface 27*a* and the recording medium P that come into surface contact with each other can be reduced and the recording medium P can be peeled off efficiently.

In the thermal head X1 of the present embodiment, the skewness Rsk of the lateral surface 27*b* may be higher than zero. In such a configuration, the lateral surface 27*b* is configured such that there are more hills than valleys. As a result, even if a paper fragment or the like breaks loose from the recording medium P, the paper fragment hardly enters the valley and hardly fills up the valley.

In the thermal head X1 of the present embodiment, the skewness Rsk of the upper surface 27*a* may be higher than zero. In such a configuration, the upper surface 27*a* is configured such that there are more hills than valleys. As a result, even if a paper fragment or the like breaks loose from the recording medium P, the paper fragment hardly enters the valley and hardly fills up the valley. The recording medium P that is in surface contact can be supported by a large number of hills (the second protrusion portions 30*b*).

In the thermal head X1 of the present embodiment, the skewness Rsk of the lateral surface 27*b* may be higher than the skewness Rsk of the upper surface 27*a*. In such a configuration, the lateral surface 27*b* is configured to have a higher ratio of hills to valleys than the upper surface 27*a*. That is, on the lateral surface 27*b*, a large number of hills (first protrusion portions 30*a*) support the recording medium P. As a result, a large number of first protrusion portions 30*a* support the recording medium P in the vicinity of the lateral surface 27*b* where a strong pressing force is generated so that the lateral surface 27*b* is hardly damaged.

In the thermal head X1 of the present embodiment, the kurtosis Rku of the lateral surface 27*b* may be higher than 3. In such a configuration, the hills of the lateral surface 27*b* are configured to be highly peaked. As a result, the first protrusion portion 30*a* and the recording medium P come into point contact with each other. As a result, the recording medium P hardly sticks to the lateral surface 27*b*. Therefore, recording medium P can be peeled off from the lateral surface 27*b* efficiently.

In the thermal head X1 of the present embodiment, the kurtosis Rku of the upper surface may be lower than 3. In such a configuration, the hills (the second protrusion portions 30*b*) of the upper surface 27*a* are configured to be slightly peaked. As a result, even in contact with the second protrusion portion 30*b*, the recording medium P hardly incurs transport damage. That is, the recording medium P is transported toward the heat generating unit 9 in contact with the upper surface 27*a*, but the hills of the upper surface 27*a* are slightly peaked so that the recording medium P hardly incurs transport damage.

As shown in FIG. 4, the covering layer 27 may have an extension portion 28 extending between the driver ICs 11 when viewed in plan. In such a configuration, the shape of the covering member 29 can be stabilized. That is, the amount of the covering member 29 is smaller in the region in which the driver IC 11 is not disposed than in the region in which the driver IC 11 is disposed in some cases, but even when the amount of the covering member 29 is smaller, since the covering layer 27 has the extension portion 28, the height of the covering member 29 from the base portion 13*a* can be secured and the recording medium P and the covering member 29 can be brought into almost uniform contact with each other.

The thermal head X1 can be manufactured by the following method, for example.

Various electrodes are patterned on the substrate 7, and the covering layer 27 resin is screen-printed and cured so that the opening 27*c* is provided as shown in FIG. 4. Next, the driver IC 11 is mounted and the resin for the covering member 29 is applied by a dispenser and cured. At this time, the resin for the covering member 29 is applied so that the edge after curing is positioned on the upper surface 27*a* of the covering layer 27.

Next, the end portion of the covering layer 27 on the side of the raised portion 13*b* is ground and the lateral surface 27*b* is formed. A wrapping film can be used to perform grinding. In this way, it is possible to manufacture the thermal head X1 in which the arithmetic-average surface roughness Ra of the lateral surface 27*b* is higher than the arithmetic-average surface roughness Ra of the upper surface 27*a*. The lateral surface 27*b* may be formed by blasting etching or the like.

In the present embodiment, the lateral surface 27*b* is a portion positioned closer to the substrate 7 than an imaginary line parallel to the upper surface 27*a* on a cut surface which is obtained by cutting the thermal head X1 in a direction perpendicular to the thickness direction of the substrate 7 and the main scanning direction and formed continuously from the upper surface 27*a*. The lateral surface 27*b* may not necessarily be inclined with respect to the upper surface 27*a*.

Figure 8:
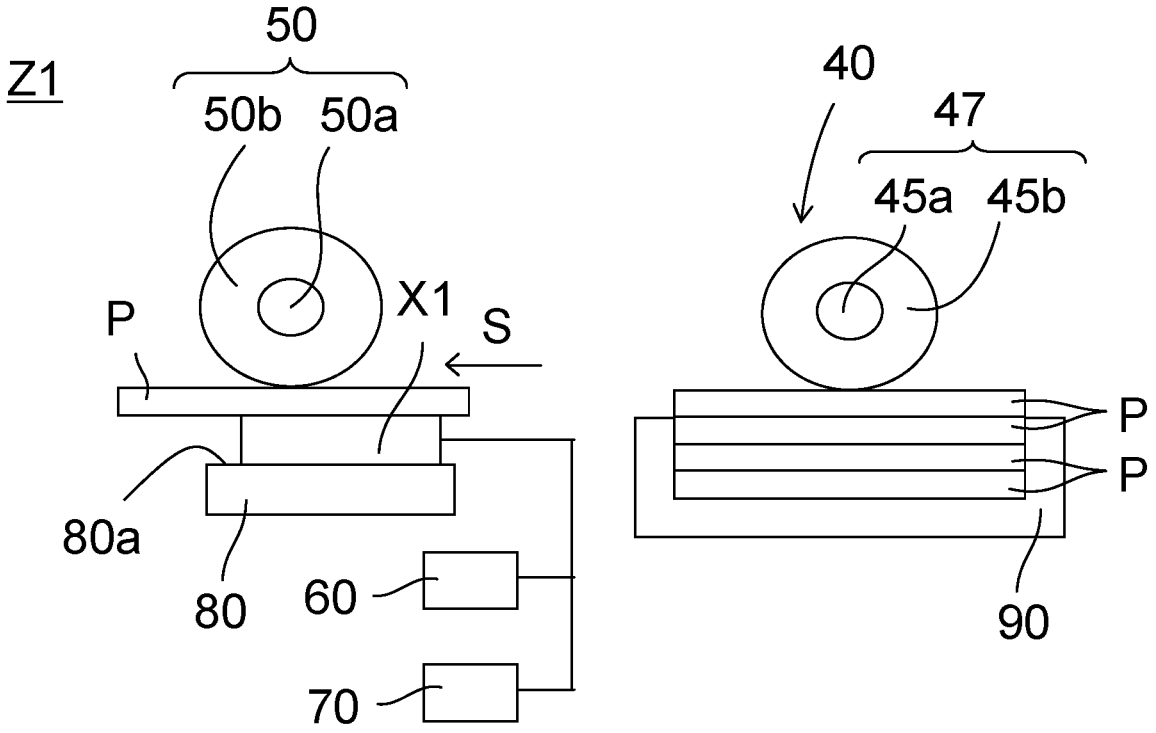
FIG. 8 is a view showing an outline of a transport state of a recording medium by the thermal head shown in FIG. 1.

Next, a thermal printer Z1 having the thermal head X1 will be described with reference to FIG. 8.

The thermal printer Z1 of the present embodiment includes the thermal head X1 described above, a transport mechanism 40, the platen roller 50, a power supply device 60, a control device 70, an attachment member 80, and a paper feeding unit 90. The thermal head X1 is attached to an attachment surface 80*a* of the attachment member 80 disposed in a casing (not shown) of the thermal printer Z1. The thermal head X1 is attached to the attachment member 80 in the main scanning direction orthogonal to the transport direction S.

The transport mechanism 40 has a driving unit (not shown) and a transport roller 47. The transport mechanism 40 transports the recording medium P such as thermal paper, image receiving paper to which ink is transferred, or the like in the arrow S direction of FIG. 8 such that the recording medium P passes over the protective layer 25 positioned above a plurality of heat generating units 9 of the thermal head X1.

The driving unit drives the transport roller 47 and a motor can be used, for example. The transport roller 47 can be configured with a cylindrical shaft body 45*a* made of metal such as stainless steel or the like and covered with an elastic member 45*b* made of butadiene rubber or the like, for example. When the recording medium P is an image receiving paper to which ink is transferred, an ink film (not shown) is transported, together with the recording medium P, between the recording medium P and the heat generating unit 9 of the thermal head X1.

The platen roller 50 presses the recording medium P onto the protective layer 25 positioned on the heat generating unit 9 of the thermal head X1. The platen roller 50 is disposed to extend in the main scanning direction and both end portions of thereof are rotatably supported and fixed in a state where the recording medium P is pressed onto the heat generating unit 9. The platen roller 50 can be configured with a cylindrical shaft body 50*a* made of metal such as stainless steel or the like and covered with an elastic member 50*b* such as butadiene rubber or the like, for example.

The power supply device 60 supplies a current for causing the heat generating unit 9 of the thermal head X1 to generate heat and a current for operating the driver IC 11 as described above. The control device 70 supplies a control signal for controlling the operation of the driver IC 11 to the driver IC 11 to selectively causing the heat generating unit 9 of the thermal head X1 to generate heat as described above.

The paper feeding unit 90 accommodates a plurality of recording media P. The recording medium P in the paper feeding unit 90 is transported by the transport roller 47 one by one and printed by the thermal head X1.

The thermal printer Z1 transports the recording medium P by the transport mechanism 40 so that the recording medium P passes over the heat generating unit 9 while pressing the recording medium P onto the heat generating unit 9 of the thermal head X1 by the platen roller 50. The thermal printer Z1 performs predetermined printing on the recording medium P by selectively causing the heat generating unit 9 to generate heat by the power supply device 60 and the control device 70.

Second Embodiment

Figure 9:
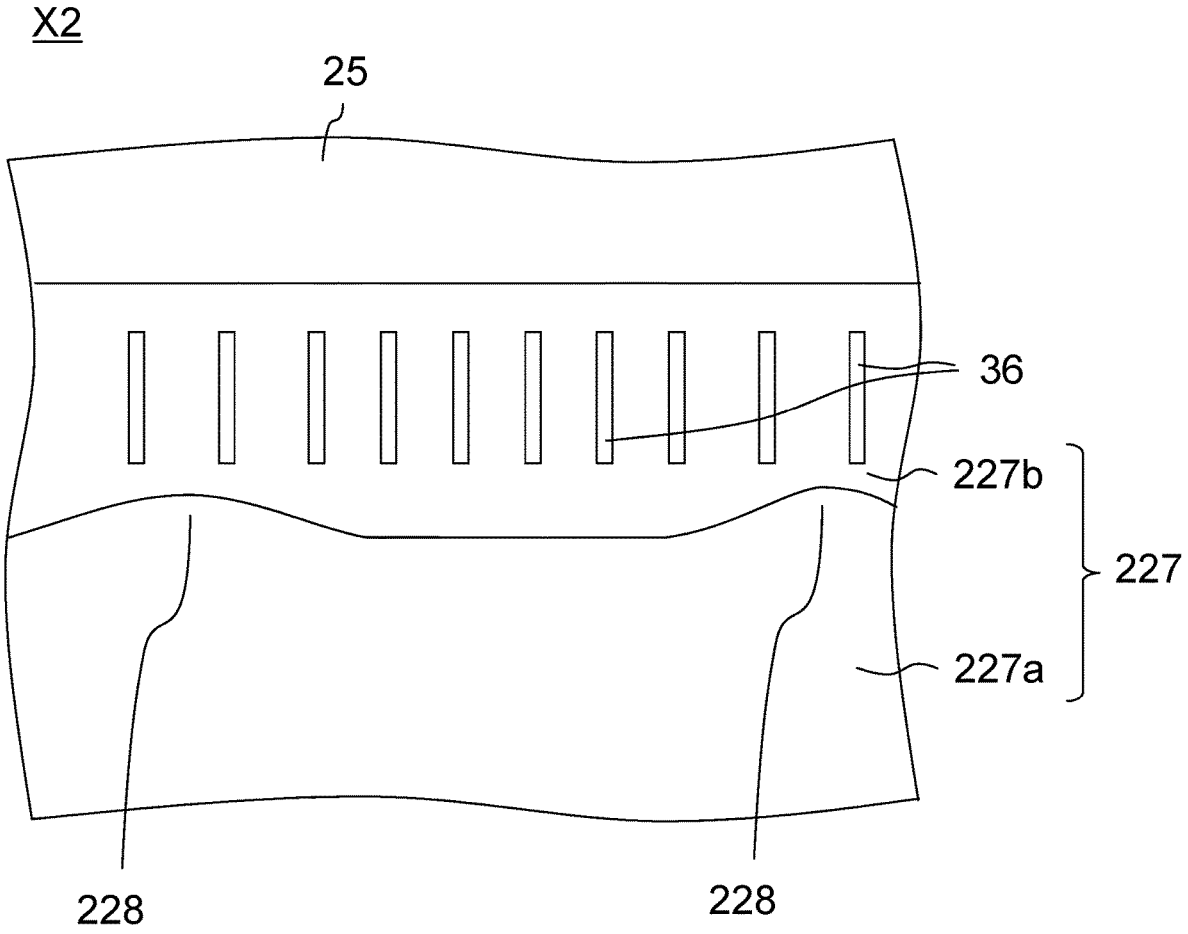
FIG. 9 is a plan view showing a thermal head according to a second embodiment and showing an enlarged lateral surface of a covering layer.

A thermal head X2 according to a second embodiment will be described with reference to FIG. 9. The same members as the members of the thermal head X1 will be assigned the same reference numerals and the description thereof will be omitted. A covering layer 227 of the thermal head X2 is different from the covering layer 27 of the thermal head X1 in the configuration.

In the covering layer 227, an upper surface 227*a* has extension portions 228 extending toward the protective layer 25 in the sub-scanning direction when viewed in plan. The extension portions 228 are arranged separated from each other in the main scanning direction when viewed in plan.

The lateral surface 227*b* is provided with a plurality of grooves 36. The grooves 36 have a shape long in the sub-scanning direction. The grooves 36 are disposed separated from each other in the sub-scanning direction. The grooves 36 are formed of the adjacent first protrusion portions 30*a* (refer to FIG. 7) and are composed of the first recess portions 32*b*.

In the thermal head X2 of the present embodiment, the lateral surface 227*b* is provided with the grooves 36 and the grooves 36 may have a shape long in the sub-scanning direction when viewed in plan. In such a configuration, when the recording medium P is transported in contact with the lateral surface 227*b*, a gap can be formed between the recording medium P and the lateral surface 227*b* and the transport of the recording medium P is hardly disturbed. As a result, the recording medium P is transported smoothly in contact with the lateral surface 227*b* and is peeled off from the lateral surface 227*b* smoothly.

The upper surface 227*a* may have an extension portion 228 extending toward the protective layer 25 in the sub-scanning direction when viewed in plan. In such a configuration, the recording medium P is transported in contact with the extension portion 228 in the region in which the extension portion 228 is disposed and in a state of being peeled off from the upper surface 227*a* in the region in which the extension portion 228 is not disposed. As a result, the recording medium P is transported with a gap from the upper surface 227*a* in the region in which the extension portion 228 is not disposed, and the sticking between the recording medium P and the upper surface 227*a* can be reduced.

A plurality of embodiments is described above, and the present disclosure is not limited to the embodiments. Various modifications can be made without deviating from the scope of the disclosure. For example, the thermal printer Z1 using the thermal head X1 which is the first embodiment is presented, but the present disclosure is not limited thereto and the thermal head X2 may be used in the thermal printer Z1. The thermal heads X1 and X2 which are a plurality of embodiments may be combined.

An example of the heat storage layer 13 having the base portion 13*a* and the raised portion 13*b* is presented, and the present disclosure is not limited thereto. The base portion 13*a* may not be disposed and the raised portion 13*b* may not be disposed.

A thin film head of the heat generating unit 9 by way of thin film formation of the electric resistance layer 15 is presented as an example, and the present disclosure is not limited thereto. For example, the present disclosure may be applied to a thick film head obtained by forming the electric resistance layer 15 with a thick film after various electrodes are patterned.

REFERENCE SIGNS LIST

X1, X2 thermal head
Z1 thermal printer
1 heat sink

3 head base
5 flexible printed circuit
7 substrate
9 heat generating unit
19 individual electrode (electrode)
25 protective layer
27 covering layer
27*a* upper surface
27*b* lateral surface
27*c* opening
28 extension portion
29 covering member
29*a* vertex
29*b* lateral surface
29*c* edge
30*a* first protrusion portion
30*b* second protrusion portion
32*a* first recess portion
32*b* second recess portion
34 depression portion
36 groove
P recording medium

The invention claimed is:

1. A thermal head comprising:
a substrate;
a heat generating unit above the substrate;
an electrode above the substrate, the electrode being connected to the heat generating unit;
a covering layer, the covering layer covering at least a part of the electrode when viewed in plan, comprising an upper surface and a lateral surface that is positioned on a side of the heat generating unit, and having an arithmetic-average surface roughness Ra of the lateral surface is higher than an arithmetic-average surface roughness Ra of the upper surface; and
a covering member on the covering layer,
wherein a mean length RSm of the upper surface is shorter than a mean length RSm of the lateral surface, and
wherein the mean length RSm is a mean of a plurality of lengths of contour curve elements in a reference length.

2. The thermal head according to claim 1, wherein
a maximum height Rz of the lateral surface is higher than a maximum height Rz of the upper surface.

3. The thermal head according to claim 1, wherein
the lateral surface is provided with a plurality of first protrusion portions separated from each other,
the upper surface is provided with a plurality of second protrusion portions separated from each other, and
an interval between adjacent protrusion portions of the plurality of first protrusion portions is smaller than an interval between adjacent protrusion portions of the plurality of second protrusion portions.

4. The thermal head according to claim 3, wherein
the lateral surface is inclined with respect to a thickness direction of the substrate, and
the lateral surface is provided with a groove that has a shape long in a sub-scanning direction when viewed in plan.

5. The thermal head according to claim 3, wherein
a mean line of a vertex distribution of the plurality of first protrusion portions is positioned above a mean line of a roughness curve of the lateral surface in a cross section in a thickness direction of the substrate and a main scanning direction.

6. The thermal head according to claim 3, wherein
the upper surface is provided with a depression portion, and
the plurality of second protrusion portions is disposed in the depression portion.

7. The thermal head according to claim 1, wherein
the upper surface is provided with a depression portion.

8. The thermal head according to claim 1, wherein
a skewness Rsk of the lateral surface is higher than zero.

9. The thermal head according to claim 8, wherein
a skewness Rsk of the upper surface is higher than zero.

10. The thermal head according to claim 9, wherein
the skewness Rsk of the lateral surface is higher than the skewness Rsk of the upper surface.

11. The thermal head according to claim 1, wherein
a kurtosis Rku of the lateral surface is higher than 3.

12. The thermal head according to claim 11, wherein
a kurtosis Rku of the upper surface is lower than 3.

13. A thermal printer comprising:
the thermal head according to claim 1;
a transport mechanism for transporting a recording medium and passing the recording medium over the heat generating unit; and
a platen roller for pressing the recording medium.

14. A thermal head comprising:
a substrate;
a heat generating unit above the substrate;
an electrode above the substrate, the electrode being connected to the heat generating unit;
a covering layer, the covering layer covering at least a part of the electrode when viewed in plan, comprising an upper surface and a lateral surface that is positioned on a side of the heat generating unit, and having an arithmetic-average surface roughness Ra of the lateral surface is higher than an arithmetic-average surface roughness Ra of the upper surface; and
a covering member on the covering layer, and
wherein a skewness Rsk of the lateral surface is higher than zero.

15. The thermal head according to claim 14, wherein
a skewness Rsk of the upper surface is higher than zero.

16. The thermal head according to claim 15, wherein
the skewness Rsk of the lateral surface is higher than the skewness Rsk of the upper surface.

17. A thermal head comprising:
a substrate;
a heat generating unit above the substrate;
an electrode above the substrate, the electrode being connected to the heat generating unit;
a covering layer, the covering layer covering at least a part of the electrode when viewed in plan, comprising an upper surface and a lateral surface that is positioned on a side of the heat generating unit, and having an arithmetic-average surface roughness Ra of the lateral surface is higher than an arithmetic-average surface roughness Ra of the upper surface; and
a covering member on the covering layer, and
wherein a kurtosis Rku of the lateral surface is higher than 3.

18. The thermal head according to claim 17, wherein
wherein a kurtosis Rku of the upper surface is lower than 3.

* * * * *